US012275575B2

(12) United States Patent
McDonald et al.

(10) Patent No.: US 12,275,575 B2
(45) Date of Patent: Apr. 15, 2025

(54) CHILD RESISTANT DIAL TRAP PACK

(71) Applicant: Sonoco Development, Inc., Hartsville, SC (US)

(72) Inventors: Todd LaMont McDonald, Sycamore, IL (US); Robert Timothy Lynn, Jr., Marengo, IL (US)

(73) Assignee: Sonoco Development, Inc., Hartsville, SC (US)

( * ) Notice: Subject to any disclaimer, the term of this patent is extended or adjusted under 35 U.S.C. 154(b) by 664 days.

(21) Appl. No.: 17/675,184

(22) Filed: Feb. 18, 2022

(65) Prior Publication Data

US 2023/0264888 A1 Aug. 24, 2023

(51) Int. Cl.

*B65D 83/04* (2006.01)
*B65D 75/36* (2006.01)
*B65D 75/56* (2006.01)

(52) U.S. Cl.

CPC ..... *B65D 83/0454* (2013.01); *B65D 75/367* (2013.01); *B65D 75/563* (2013.01); *B65D 2575/565* (2013.01)

(58) Field of Classification Search

CPC .... B65D 83/0454; B65D 83/04; B65D 73/36; B65D 75/36; B65D 75/367; B65D 75/563; B65D 2575/565; A61J 1/03

USPC ..... 221/1

See application file for complete search history.

(56) References Cited

U.S. PATENT DOCUMENTS 3,246,747 A * 4/1966 Blish ..... B65D 73/0092 206/469
8,672,134 B2 3/2014 Sprada et al.
9,422,101 B2 8/2016 Wu
D876,819 S * 3/2020 Kim ..... D3/203.1
2002/0153278 A1* 10/2002 Pirro ..... B65D 73/0092 206/703
2003/0155276 A1* 8/2003 Gaffney ..... B65D 83/0454 206/704
2004/0188312 A1* 9/2004 Stepowany ..... B65D 75/327 206/531
2008/0032407 A1* 2/2008 Brown ..... G01N 33/4875 221/88
2012/0125796 A1* 5/2012 Falcon ..... B65D 73/0092 206/468
2012/0181204 A1* 7/2012 Bogdziewicz, III ..... B65D 83/0463 206/468
2012/0205276 A1* 8/2012 Shackford ..... B65D 75/366 206/469

(Continued)

FOREIGN PATENT DOCUMENTS

BR 202018075063 U2 * 6/2019 ..... A63F 5/048
CN 106904375 A * 6/2017 ..... A61J 1/035

(Continued)

OTHER PUBLICATIONS

International Search Report and Written Opinion related to Application No. PCT/US2022/052137; reported on Apr. 14, 2023.

*Primary Examiner* — Rakesh Kumar
(74) *Attorney, Agent, or Firm* — von Briesen & Roper, s.c.

(57) ABSTRACT

A child resistant container comprising a blister and a sleeve. The blister comprises a plurality of compartments arranged radially around a centrally disposed hub. Each compartment defines a cavity for holding contents. The container is a "dial pack" type container in that the blister can be rotated with respect to the sleeve to expose each cavity in turn.

20 Claims, 5 Drawing Sheets

(56) References Cited

U.S. PATENT DOCUMENTS

| | | | | |
|---|---|---|---|---|
| 2012/0228177 | A1* | 9/2012 | Schwester | B65D 73/0092 206/462 |
| 2013/0015197 | A1* | 1/2013 | Gauthier | B65D 83/0454 221/82 |
| 2013/0228488 | A1* | 9/2013 | Wu | B65D 83/04 493/52 |
| 2015/0166231 | A1* | 6/2015 | Taylor | B65D 51/185 220/255 |
| 2015/0284174 | A1* | 10/2015 | Vogels | B65D 83/0454 221/69 |
| 2020/0121560 | A1* | 4/2020 | Thomas | B65D 83/0454 |
| 2021/0245944 | A1* | 8/2021 | McDonald | B65D 75/367 |
| 2023/0264888 | A1* | 8/2023 | McDonald | B65D 75/367 221/1 |

FOREIGN PATENT DOCUMENTS

| | | | | |
|---|---|---|---|---|
| CN | 106904375 | | 1/2020 | |
| GB | 2401602 | A | 11/2004 | |
| JP | 06-027646 | U | 4/1994 | |
| JP | 2002347761 | A | 12/2002 | |
| JP | 2005132417 | A | 5/2005 | |
| WO | WO-2004069688 | A2 * | 8/2004 | B65D 83/0463 |

* cited by examiner

CHILD RESISTANT DIAL TRAP PACK

BACKGROUND

Field of the Invention

This patent relates to a child resistant container. More particularly, this patent relates to a blister type child resistant container for the pharmaceutical market and other markets.

Description of the Related Art

There are numerous child resistant packages on the market, some that are more effective than others. The present disclosure relates to a novel, blister type child resistant package having a plurality of product compartments.

SUMMARY OF THE INVENTION

This disclosure relates to a blister type child resistant container for the pharmaceutical market and other markets. The container is comprised of a blister sandwiched between a front card and a back card.

In one aspect the blister comprises a substantially planar, circular body and a plurality of compartments. The blister includes score lines that define a tamper evident pull tab. The front card defines a locking boss opening and a large opening configured to receive a plurality of compartments.

The blister is rotatably sandwiched between the front card and the back card. The blister comprises a generally planar, circular body and the plurality of compartments. The compartments extend downward from the body and are arranged radially around a centrally disposed hub. The hub defines a central rotational axis. Each compartment defines a cavity for holding contents. Each compartment comprises a bottom wall and a sidewall extending upward from the bottom wall and terminating in a top edge co-planar with the body.

The body defines a plurality of semi-circular notches disposed around a periphery of the body. Each notch is located radially outward from a corresponding compartment.

The blister further comprises a member extending radially outward from the body and connected to the body by a removeable tab. The member comprises a downwardly extending locking boss.

The container is configurable between a first, locked position in which the locking boss extends through the locking boss opening and nests within one of the plurality of notches so that the blister cannot rotate with respect to the front card and the back card, and an unlocked position in which the locking boss does not extend through the opening and the blister is rotatable with respect to the front card and the back card about the central axis (A).

THE DRAWINGS

DETAILED DESCRIPTION OF THE INVENTION

Figure 2:
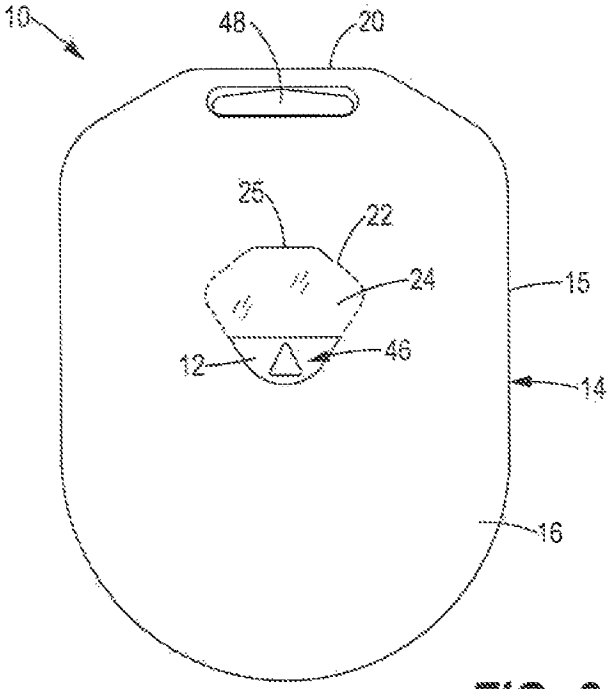
FIG. 2 is a bottom view of the child resistant container of FIG. 1.
Figure 3:
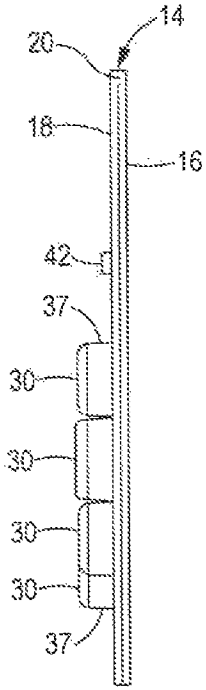
FIG. 3 is a side view of the child resistant container of FIG. 1.

While the subject of this disclosure may be embodied in many forms, there is shown in the drawings and will herein be described in detail one or more embodiments with the understanding that this disclosure is to be considered an exemplification of the principles of the disclosure and is not intended to limit the disclosure to the illustrated embodiments.

As will be appreciated, terms such as "above" and "below", "upper" and "lower", "top" and "bottom," "front" and "back," (etc.), used as nouns, adjectives or adverbs refer in this description to the orientation of the structure of the container and its components as it is illustrated in the various views. Such terms are not intended to limit the invention to a particular orientation.

The Child Resistant Container

This disclosure relates to a blister type child resistant container 10 for the pharmaceutical market and other markets. FIGS. 1 to 8 are various views of a child resistant container 10 according to the disclosure. The container 10 comprises a blister 12 rotatably sandwiched between a back card 16 and a substantially co-extensive front card 18. The back card 16 and the front card 18 may be connected to form a hinged, clamshell-type sleeve 14.

Sleeve 14

Referring to FIGS. 1 to 4, the front card 18 and back card 16 may be separate pieces, or they may be a single piece of material such as paperboard connected by an integrally formed living hinge 20. As explained further below, when folded so that the back card 16 is in flat facing abutment with the front card 18, the sleeve 14 captures the blister 12 therebetween so that the blister 12 can be rotated with respect to the sleeve 14.

Figure 1:
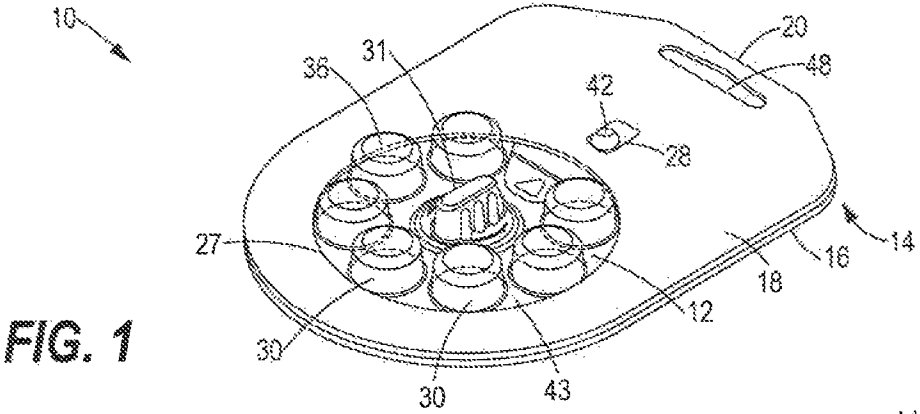
FIG. 1 is a top perspective view of a child resistant container according to the disclosure, the container comprising a blister and a sleeve.
Figure 4:
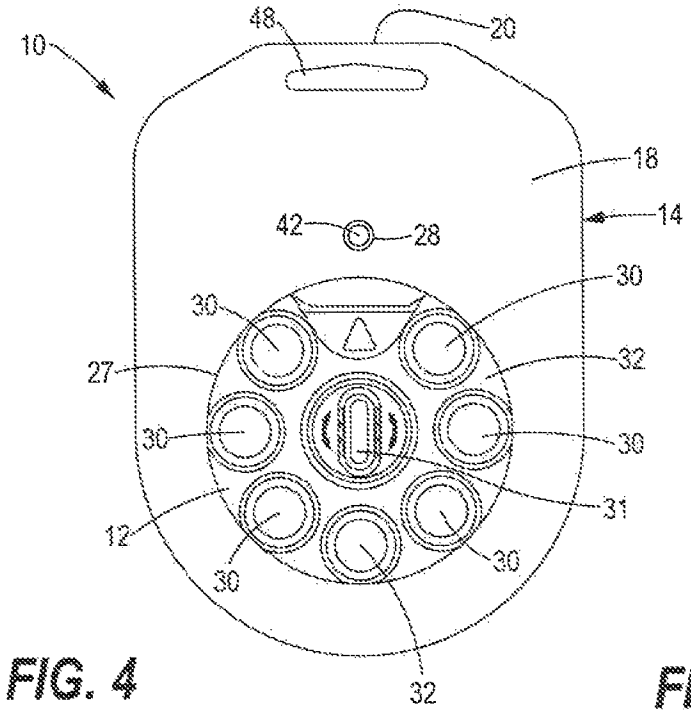
FIG. 4 is a top view of the child resistant container of FIG. 1.

As best shown in FIGS. 1 and 4, the front card 18 defines a large opening 27 through which the blister compartments 30 extend. Preferably the large opening 27 is substantially circular and has a diameter the same as or slightly larger than the diameter defined by the radially outer surfaces of the sidewalls 37 of the compartments 30. In this way the blister 12 fits snugly between the front card 18 and the back card 16 but still can be rotated.

The front card 18 also defines a small locking boss (button) opening 28, the purpose of which is explained below. The small button opening 28 may be circular as shown in FIG. 4 or any suitable shape. Preferably the small button opening 28 has a shape that is complimentary to the shape of the locking boss 42 that extends upwardly there though.

Figure 14:
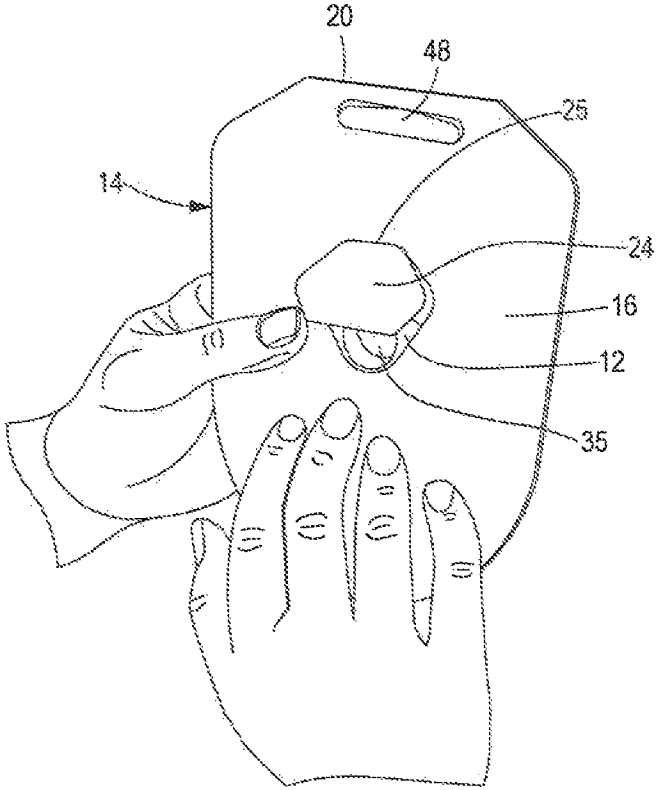
FIG. 14 is a bottom perspective view of the child resistant container showing a user accessing the contents of one of the cavities.

As viewed from the bottom facing side of the back card 16 (as shown in FIG. 2), the back card 16 includes perforations and/or score lines 22 that define the perimeter of a flap 24. The perimeter of the flap 24 may include a hinge 25. The flap 24 may be hingedly connected to the rest of the back card 16 along the hinge 25. When the flap 24 is pulled up, it creates an opening 26 (dispensing window) in the back card 16 that initially exposes a tab 44 (FIG. 9), and later may expose a portion or all of a compartment cavity 35 (FIG. 14). Thus, the flap 24 should be located such that it is aligned with the removeable tab 44, and preferably so that a portion or all of each blister compartment cavity 35 will appear in the dispensing window 26 as the blister 12 is rotated.

Figure 6:
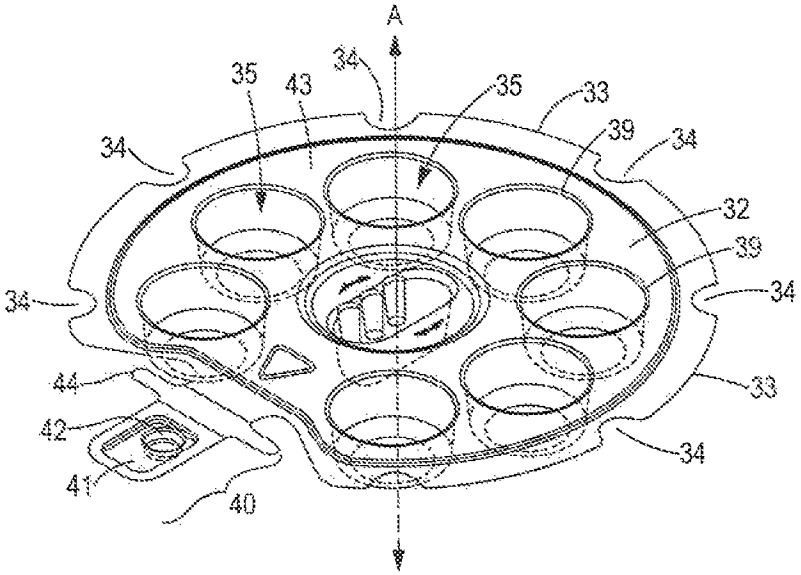
FIG. 6 is a bottom perspective view of the blister of FIG. 5.

After being folded about the living hinge 20, the inner facing sides of the back card 16 and the front card 18 may be adhered or otherwise affixed to each other in such a way that secures the blister 12 therebetween while allowing the blister 12 to rotate about an axis (A) (FIG. 6). This may be accomplished by applying adhesive to the back card 16 and/or to the front card 18 in a desired adhesive pattern such as near the perimeter 15 of the inner facing side of either the back card 16 or the front card 18, positioning the blister 12 onto the front card 18 so that the compartments extend through the large opening 27 and the blister body 32 rests on the inner facing surface of the front card 18, then folding the back card 16 over so that it in in flat facing abutment with the front card 18 while simultaneously adhering the back card 16 to the front card 18.

As perhaps best shown in FIG. 2, the back card 16 and the integral flap 24 together may define a small finger opening 46 to make it easier for a user to lift the flap 24. The flap 24 and the back card 16 may be made from (cut out of) a single piece of material that is die cut around the perimeter 15 of the back card 16 and also partially die cut to create perforations around the perimeter 22 of the flap 24. The flap perimeter 22 may be any suitable size and shape that, when the flap 24 is lifted, allows access to a cavity 35. Alternatively, instead of a flap 24, the front card 18 and back card 16 can simply define a window where the flap 24 is otherwise located.

Optionally, the front card 18 and the back card 16 may define a slot or other opening 48 to accommodate, for example, a display hook. Preferably the opening 48 consists of one opening in the back card 16 and a second opening in the front card 18, with both top and bottom openings in substantial registration with each other.

Blister 12

Figure 8:
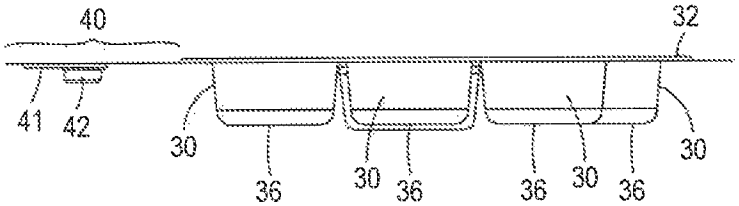
FIG. 8 is another side view of the blister of FIG. 5.
Figure 7:
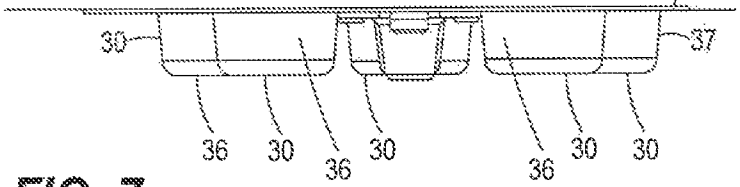
FIG. 7 is a side view of the blister of FIG. 5.

With respect to the blister 12, the terms "top", "bottom", "upward" and "downward" generally refer to the orientation of the blister 12 in FIGS. 6-8.

Referring to FIGS. 5-8, the blister 12 may be a plastic, blister type piece comprising a blister body 32 and a plurality of blister compartments 30 arranged radially around a centrally disposed blister hub 31. Each blister compartment 30 defines a space or cavity 35 for holding contents or one or more articles. Each blister compartment 30 may comprise a bottom wall 36 and a substantially cylindrical or tapered sidewall 37 extending from the bottom wall 36 and terminating in a top edge 38. The top edge 38 may be co-planar with the blister body 32.

In the illustrated embodiment the blister compartments 30 are approximately cup-shaped, but they may be any suitable shape. The sidewall 37 may be cylindrical, tapered as shown in the figures, or any suitable shape. The bottom wall 36 of each compartment 30 may be flat or inclined in whole or in part to make it easier to remove contents or articles (not shown) from the compartment 30. A step 39 (FIG. 6) may be disposed circumferentially around the top of each compartment 30.

Each compartment 30 may be sealed at the top with a frangible seal (not shown) so that the user must push against the semi-flexible bottom 36 of the compartment 30 to force the contents out through the broken seal, as is known in the industry. The frangible seal may be adhered or otherwise affixed to the blister body 32 in such a manner that breaking the seal over one compartment 30 does not break the seal over the other compartments 30.

The generally planar body 32 may have a substantially circular periphery 33 and may define a number of notches 34 disposed around the periphery 33. Each notch 34 may be substantially semi-circular and may be located radially outward from a corresponding compartment 30. In the orientation shown in FIG. 1, the compartments 30, as well as the central hub 31, extend upward from a top surface 43 of the blister body 32. In other words, after the frangible seal that seals a particular compartment 30 has been broken, the cavity 35 defined by that now-opened compartment 30 can be accessed from the top surface 43 of the blister body 32.

The blister 12 further comprises a radially extending member 40 comprising a button or locking boss 42 that is initially connected to the blister body 32 by a tab 44. In other words, the blister 12 further comprises a member 40 that preferably extends radially outward from the substantially circular blister body 32 and is connected to the blister body 32 by a removeable tab 44. The radially extending member 40 may be substantially rectangular or any suitable shape and comprise a slightly lowered (depressed) portion 41 on which the resilient locking boss 42 is located. The locking boss 42 in turn extends downward from the lowered portion 41. In the assembled container 10, the resilient locking boss 42 extends through the small button opening 28 in the front card 18 to lock the blister 12 in place with respect to the front card 18 and the back card 16.

Figure 5:
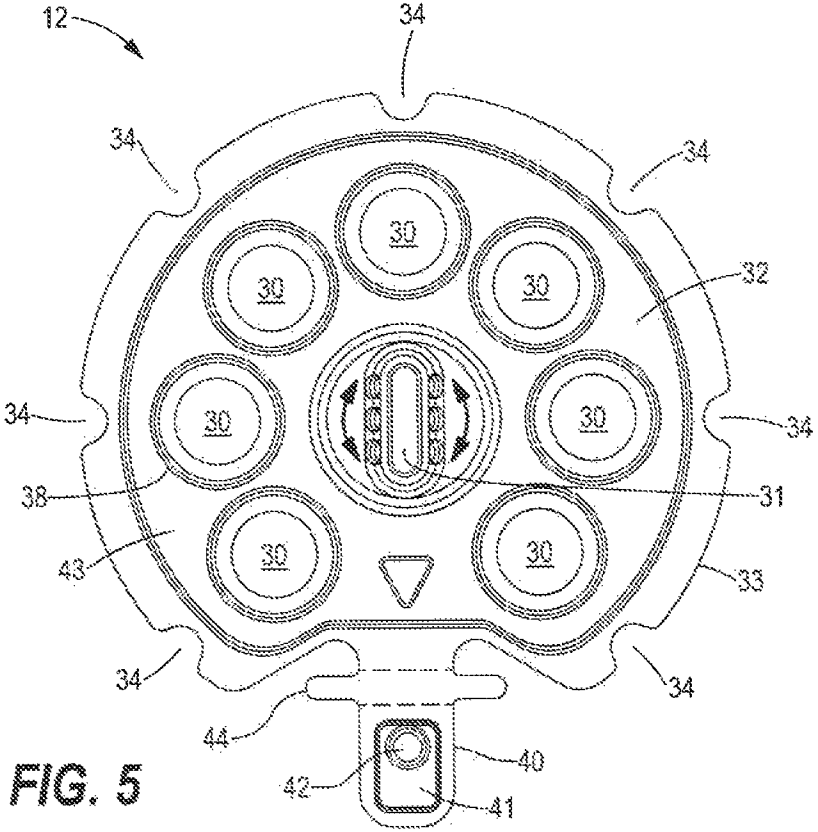
FIG. 5 is a top view of a blister used as a component of the child resistant container according to the disclosure.

The blister hub 31 may be used to manually rotate the blister 12. Thus, it is preferred that the blister hub 31 have an elongated, textured shape that renders it easy to turn in either direction, clockwise or counterclockwise. Preferably the blister hub 31 is originally oriented so that its length is linearly aligned with the radially extending member 40 as shown in FIGS. 5 and 6. Directional arrows may be embossed in or otherwise marked on the blister 12 near the hub 31 to indicate the two possible directions of rotation, as shown in the figures. The blister hub 31 may define a central axis (A), orthogonal to the plane of the blister body 32, about which the blister 12 can rotate.

Method of Assembling the Container 10

The blister 12 and the sleeve 14 may be assembled to form the finished container 10 in the following manner.

First apply glue or other adhesive in a desired pattern to the inner facing surface(s) of the front card 18 and/or the back card 16 so that the back card 16 will adhere to the front card 18 when the sleeve 14 is folded. For example, adhesive may be applied near the perimeter 15 of the inner facing surface of the front card 18 and/or the back card 16. Also, it is desirable for all of part of the radially extending member 40 to be adhered to the inner facing surface of the front card 18 and/or to the inner facing surface of the back card 16 so that the locking boss 42 remains in register with the small opening 28 in the front card 18. In short, adhesive should be applied in pre-determined locations so that the back card 16 and front card 18 will be adhered to each other (when the sleeve 14 is folded 180 degrees along hinge 20 so that the back card 16 and front card 18 are in substantially flat facing abutment) and so that a portion of the radially extending member 40 (including the locking boss 42) on the side of the tab 44 away from the blister body 32 (but not the tab 44 itself) will be adhered to the back card 16 and/or the front card 18.

Second, position the blister 12 onto the inner facing surface of the front card 18 or the back card 16 so that the compartments 30 will extend through the large opening 27 and the locking boss 42 will extend through the small opening 28. In this position the blister body 32 contacts the inner facing surface of the front card 18. Of course, the blister 12 will be oriented so that the locking boss 42 aligns with the small opening 28 as shown in FIGS. 1 and 4. As noted above, after this step, the portion of the radially extending member 40 (including the locking boss 42) on the side of the tab 44 away from the blister body 32 may be adhered to the front card 18.

Third, fold the sleeve 14 about the living hinge 20 so that the back card 16 and the front card 18 are adhered or otherwise affixed to each other in such a way that secures the blister 12 therebetween while allowing the blister 12 to rotate about the axis (A). After folding, the back card 16 should be in flat facing abutment with the front card 18, with the back card 16 adhered to the front card 18 in desired locations, such as around the perimeter 15.

In the assembled container 10, the sleeve 14 is configured to enclose a portion of the blister body 32 while allowing the blister 12 to rotate. The compartments 30 and the central hub 31 extend through the large opening 27 in the front card 18. The locking boss 42 extends through the small button opening 28 in the front card 18 to lock the blister 12 in stationary (non-rotational) relationship with the front card 18 and back card 16. As explained below, when the locking boss 42 is depressed, the blister 12 can be rotated with respect to the front card 18 and back card 16.

Method of Use

Figure 9:
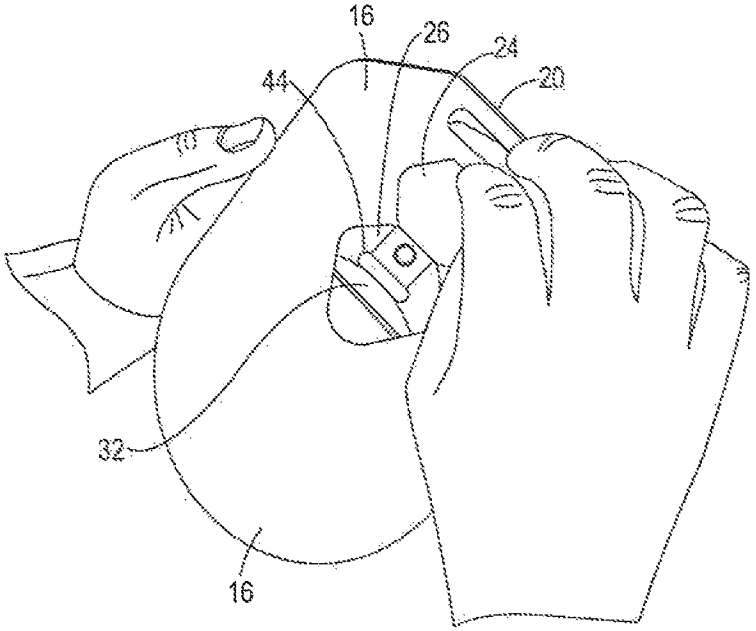
FIG. 9 is a bottom perspective view of a child resistant container according to the disclosure showing a flap being lifted.

Referring to FIGS. 9-14, the child resistant container 10 may be used as follows:

FIG. 9: First, the user pulls up on the flap 24 to reveal the dispensing window 26 and the tab 44. Since the locking boss 42 initially extends through the locking boss opening 28 and is connected to the body 32 by a tab 44, the container 10 is in a "locked" position, wherein the blister 12 cannot rotate with respect to the front card 18 and back card 16.

Figure 10:
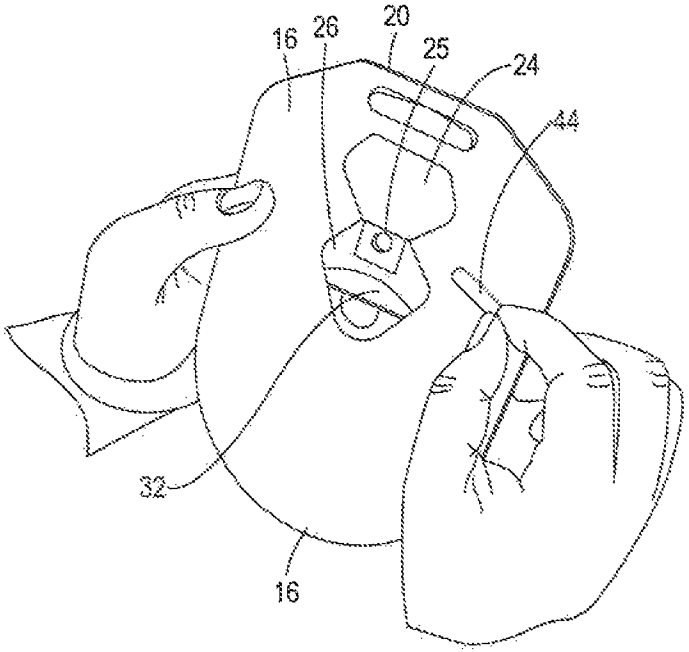
FIG. 10 is a bottom perspective view of a child resistant container after a tab (not shown) has been removed.

FIG. 10: Next, the user removes the tab 44 so the locking boss 42 is no longer connected to the blister body 32. The blister 12 is now free to rotate with respect to the front card 18 and back card 16, but only when the locking boss 42 is depressed (in the "unlocked" position).

Figure 11:
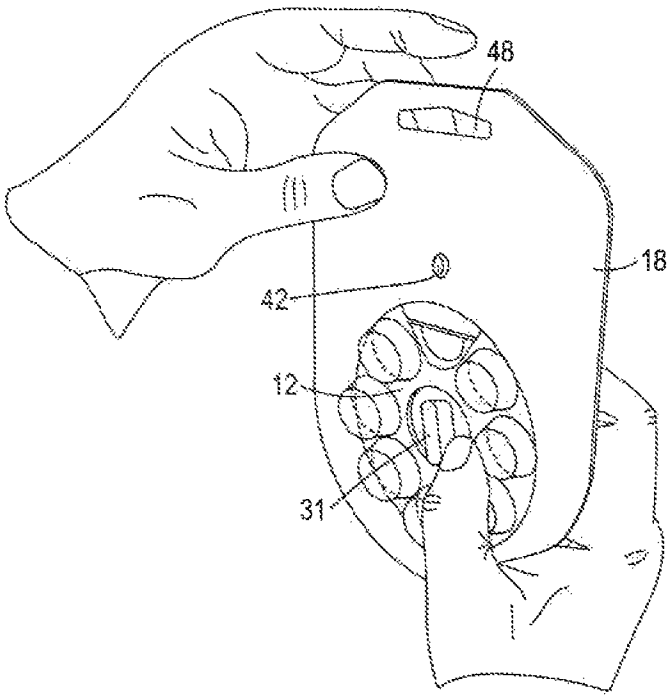
FIG. 11 is a top perspective view of the child resistant container after it has been turned over to allow easy access to a locking boss (button) that locks the blister relative to the sleeve.

FIG. 11: The user may flip over the container 10 so that the front card 18 faces upward (as also shown in FIG. 1).

Figure 12:
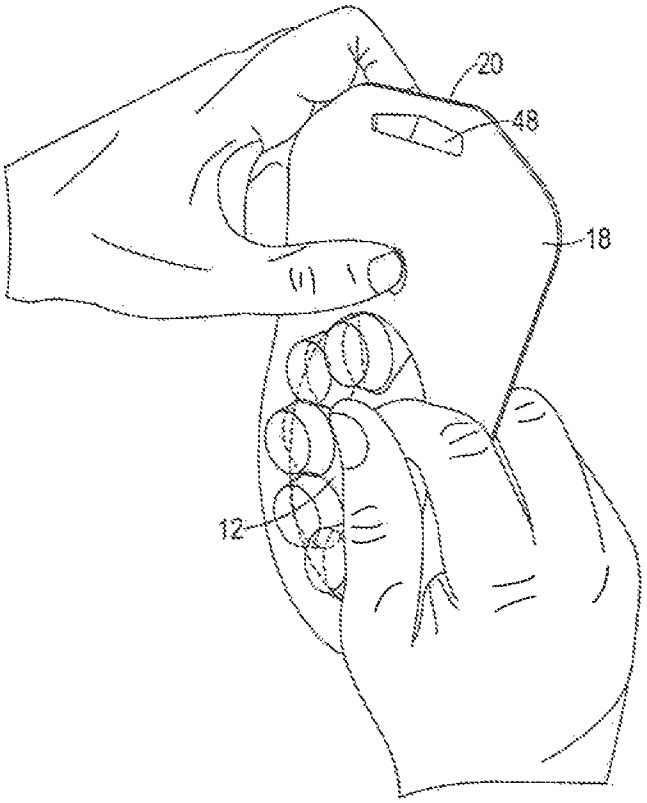
FIG. 12 is a top perspective view of the child resistant container showing the locking boss (button) being depressed.

FIG. 12: The user depresses the locking boss 42 which allows the blister 12 to rotate with respect to the front card 18 and back card 16.

Figure 13:
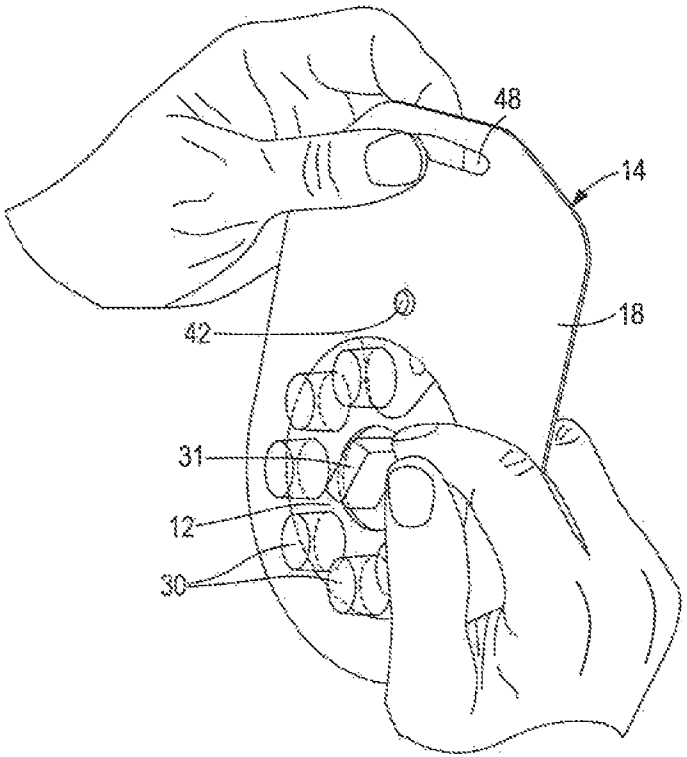
FIG. 13 is a top perspective view of the child resistant container showing the blister being rotated.

FIG. 13: The user rotates the blister 12, preferably by turning hub 31, until the next peripheral notch 34 is in the "north" position, that is, aligned with and partially surrounding (capturing) the stationary locking boss 42. During rotation, the flat area of the blister 12 near the periphery 33 slides smoothly over the locking boss 42, keeping the locking boss 42 depressed until the next notch 34 registers with the locking boss 42. In this aligned position the locking boss 42 "pops up" through the small button opening 28 in the front card 18 and nests within the next peripheral notch 34 so the blister 12 cannot rotate. The blister 12 is locked in place, with the next cavity 35, corresponding to the next notch 34, now in the "north" position, allowing access to the contents by the user.

FIG. 14: The user may now access the contents of the cavity 35 located in the "north" position by pushing on the bottom 36 of the compartment 30 and forcing the contents through the frangible seal, if any.

It is understood that the embodiments of the disclosure described above are only particular examples which serve to illustrate the principles of the disclosure. Modifications and alternative embodiments of the disclosure are contemplated which do not depart from the scope of the disclosure as defined by the foregoing teachings and appended claims. It is intended that the claims front card 18 and back card all such modifications and alternative embodiments that fall within their scope.

The invention claimed is:

1. A container comprising:

a sleeve comprising a front card and a substantially co-extensive back card connected by an integrally formed hinge;

the back card including score lines that define a flap, the flap being moveable to expose a dispensing window through which a compartment may be accessed;

the front card defining a locking boss opening and a large opening configured to receive a plurality of compartments; and a blister rotatably sandwiched between the back card and the front card, the blister comprising a generally planar, circular body and the plurality of compartments, the plurality of compartments extending from the body and arranged radially around a centrally disposed hub, the hub defining a central rotational axis (A), each compartment defining a cavity for holding contents, each compartment comprising a bottom wall and a sidewall extending from the bottom wall and terminating in a top edge co-planar with the body;

the body defining a plurality of notches disposed around a periphery of the body, each notch located radially outward from a corresponding compartment;

the blister further comprising a member extending radially outward from the body and connected to the body by a removeable tab, the member comprising a downwardly extending locking boss; wherein the container is configurable between a first, locked position in which the locking boss extends through the locking boss opening and nests within one of the plurality of notches so that the blister cannot rotate with respect to the front card and back card, and an unlocked position in which the locking boss does not extend through the opening and the blister is rotatable with respect to the front card and back card about the central axis (A).

2. The container of claim 1 wherein:

each compartment is sealed with a frangible seal.

3. The container of claim 2 wherein:

the frangible seal is adhered to the body in such a manner that breaking the seal over one compartment does not break the seal over other compartments.

4. The container of claim 1 wherein:

the flap is hingedly connected to the rest of back card and configured to expose the tab and the dispensing window when the flap is lifted or removed from the rest of the back card.

5. The container of claim 1 wherein:

the back card and the flap define a finger opening 46 to make it easier for a user to lift or remove the flap.

6. The container of claim 1 wherein:

the front card and back card are made from a single piece of material.

7. The container of claim 1 wherein:

the front card and the back card are configured to enclose a portion of the body while allowing the blister to rotate.

8. The container of claim 1 wherein:

the front card and the back card define an opening to accommodate a display hook.

9. The container of claim 1 wherein:

the bottom wall of each compartment is inclined in whole or in part to make it easier to remove the contents from the compartment.

10. A dial trap container comprising:

a sleeve comprising a front card and a substantially co-extensive back card, the back card including score lines that define a flap, the flap being moveable to expose a dispensing window through which a compartment may be accessed, the front card defining a locking boss opening and a large opening configured to receive a plurality of compartments; and a blister rotatably sandwiched between the back card and the front card, the blister comprising a generally planar, circular body and the plurality of compartments, the plurality of compartments extending from the body and arranged radially around a central rotational axis (A), each compartment defining a cavity for holding contents, the body defining a plurality of notches disposed around a periphery of the body, the blister further comprising a locking boss extending downwardly through the locking boss opening; wherein the container is configurable between a first, locked position in which the locking boss extends through the locking boss opening and nests within one of the plurality of notches so that the blister cannot rotate with respect to the front card and back card, and an unlocked position in which the locking boss does not extend through the opening and the blister is rotatable with respect to the front card and back card about the central axis (A).

11. The container of claim 10 wherein:

each compartment is sealed with a frangible seal.

12. The container of claim 11 wherein:

the frangible seal is adhered to the body in such a manner that breaking the seal over one compartment does not break the seal over other compartments.

13. The dial trap container of claim 10 wherein:

each compartment comprises a bottom wall and a sidewall extending from the bottom wall and terminating in a top edge co-planar with the body, and the bottom wall of each compartment is inclined in whole or in part to make it easier to remove the contents from the compartment.

14. The dial trap container of claim 10 wherein:

each notch is located radially outward from a corresponding compartment.

15. The dial trap container of claim 10 wherein the blister further comprises:

a member extending radially outward from the body and connected to the body by a removeable tab, wherein the locking boss extends downward from the member.

16. A method of dispensing contents from a container, the method comprising the steps of:

providing a container comprising a sleeve comprising a front card and a substantially co-extensive back card, the back card including score lines that define a flap, the front card defining a locking boss opening and a large opening configured to receive a plurality of compartments; and a blister rotatably sandwiched between the back card and the front card, the blister comprising a generally planar, circular body and the plurality of compartments, the plurality of compartments extending from the body and arranged radially around a central rotational axis (A), each compartment defining a cavity for holding contents, the body defining a plurality of notches disposed around a periphery of the body, the blister further comprising a locking boss connected to the blister body and extending downwardly through the locking boss opening;

pulling up on the flap to reveal a dispensing window and the tab;

removing the tab so the locking boss is no longer connected to the blister body;

depressing the locking boss to allow the blister to rotate with respect to the front card and back card;

rotating the blister until a compartment is aligned with the dispensing window; and accessing the contents of the compartment cavity.

17. The method of claim 16, wherein each compartment is sealed with a frangible seal, the method comprising the additional step of:

pushing on a bottom of the compartment to force the contents through the frangible seal.

18. The method of claim 16, wherein the body defines a plurality of notches disposed around a periphery of the body, wherein:

the rotating step includes rotating the blister until the next notch registers with and partially captured by the stationary locking boss.

19. The method of claim 18, wherein:

during the rotating step, the blister slides smoothly over the locking boss, keeping the locking boss depressed until the next notch registers with the locking boss.

20. The method of claim 19, wherein:

after the rotating step, the locking boss pops up through the small button opening in the front card and nests within the next peripheral notch so the blister cannot rotate.

* * * * *